US005215263A

United States Patent [19]

Getzmann

[11] Patent Number: 5,215,263

[45] Date of Patent: Jun. 1, 1993

[54] METHOD AND DEVICE FOR REGULATING THE ROTATIONAL SPEED OF AGITATOR BALL MILLS

[76] Inventor: Hermann Getzmann, Biebersteiner Str. 17, 5226 Reichshof-Heienbach, FRG, Fed. Rep. of Germany

[21] Appl. No.: 777,300

[22] PCT Filed: May 14, 1990

[86] PCT No.: PCT/DE90/00348

§ 371 Date: Dec. 13, 1991

§ 102(e) Date: Dec. 13, 1991

[87] PCT Pub. No.: WO90/15665

PCT Pub. Date: Dec. 27, 1990

[30] Foreign Application Priority Data

Jun. 21, 1989 [DE] Fed. Rep. of Germany ..... 3920273

[51] Int. Cl.[5] ..... B02C 17/16

[52] U.S. Cl. ..... 241/30; 241/36

[58] Field of Search ..... 241/33, 34, 35, 36, 241/17, 5, 30, 28

[56] References Cited

U.S. PATENT DOCUMENTS

| | | | |
|---|---|---|---|
| 4,303,205 | 12/1981 | Geiger et al. | 241/17 |
| 4,404,640 | 9/1983 | Dumbeck et al. | 241/34 |
| 4,515,318 | 5/1985 | Savonjousi | 241/35 |
| 4,635,858 | 1/1987 | Welch et al. | 241/36 |
| 4,661,911 | 4/1987 | Ellery, Sr. | 241/33 |
| 4,709,197 | 11/1987 | Goldhammer et al. | 241/36 |

FOREIGN PATENT DOCUMENTS

| | | |
|---|---|---|
| 3038794 | 5/1982 | Fed. Rep. of Germany . |
| 3623833 | 1/1987 | Fed. Rep. of Germany . |
| 3614980 | 8/1987 | Fed. Rep. of Germany . |
| 2091129 | 7/1982 | United Kingdom . |

*Primary Examiner*—Frank T. Yost
*Assistant Examiner*—Scott A. Smith
*Attorney, Agent, or Firm*—Diller, Ramik & Wight

[57] ABSTRACT

To improve the process control in a method and a corresponding device for regulating the rotational speed of agitator ball mills which have a grinding chamber with grinding balls contained therein, a rotatably mounted agitator body arranged in the grinding chamber and a drive for the agitator body, the rotational speed n of the agitator body being measured, the torque M of the agitator body is measured and the rotational speed n is so regulated that the rotational speed n, the torque M or the mechanical agitating capacity P satisfy desired values predetermined according to the relation $$P=2\pi\cdot n\cdot M(\pi=3.141\ldots).$$

8 Claims, 1 Drawing Sheet

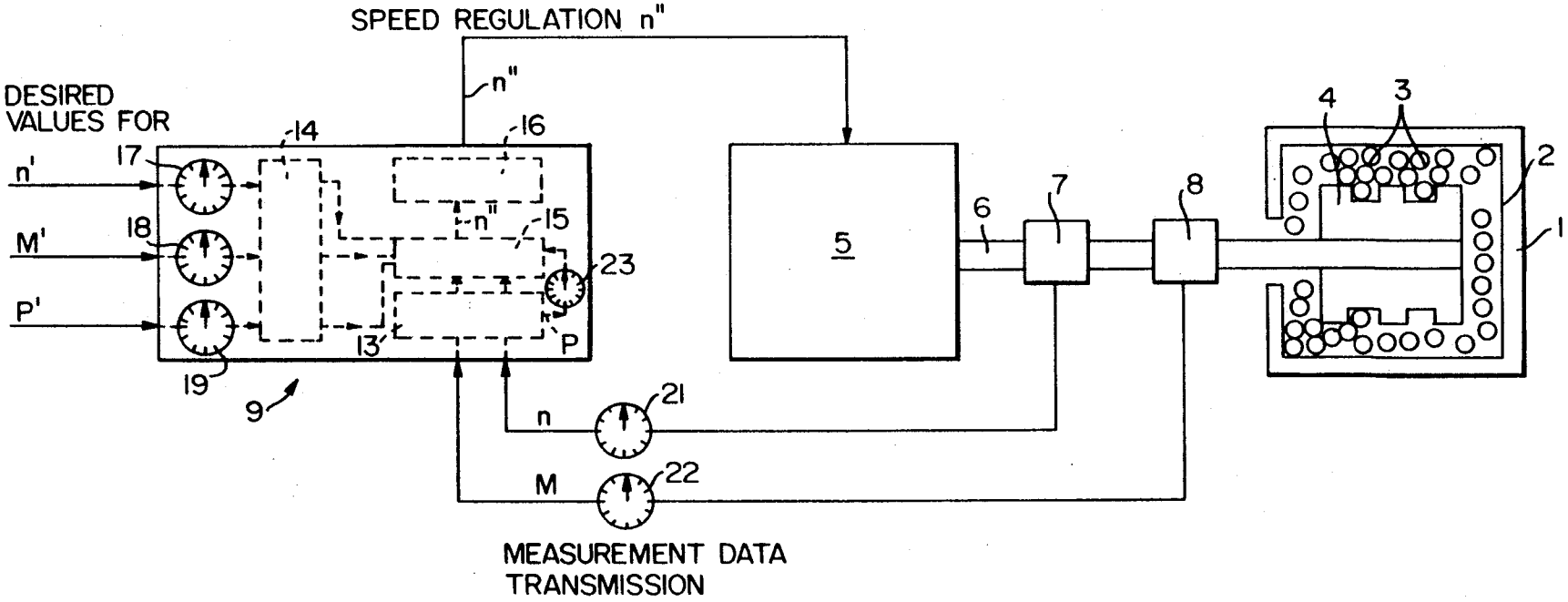
SPEED REGULATION n"
DESIRED VALUES FOR
n'
M'
P'
MEASUREMENT DATA TRANSMISSION
n
M
P
n"
1
2
3
4
5
6
7
8
9
13'
14
15
16
17
18
19
21
22
23

METHOD AND DEVICE FOR REGULATING THE ROTATIONAL SPEED OF AGITATOR BALL MILLS

BACKGROUND OF THE INVENTION

The invention relates to a method and a device for regulating the rotational speed of agitator ball mills which have a grinding chamber with grinding balls contained therein, a rotatably mounted agitator body arranged in the grinding chamber and a drive for the agitator body, the rotational speed n of the agitator body being measured.

Agitator ball mills are used, for example, for working powdered solid into liquid media (dispersal) and for the wet grinding of solid materials.

Conventionally, these agitator ball mills run either at a fixed rotational speed or else at a variable rotational speed, this being indicated on a corresponding measuring instrument.

The torque of the agitator shaft is dependent both on the internal parameters of the agitator ball mill and on the nature of the grinding material located in the grinding chamber. In the known agitator ball mills, therefore, changes in the torque of the agitator shaft occur. At high torques, there is the danger that the drive motor for the agitator shaft will be overloaded.

Success of dispersal or comminution during the operation of an agitator ball mill depends on the level of mechanical agitating capacity P. P is determined from the rotational speed n and the torque M of the agitator shaft according to the following equation $$P=2\pi\cdot n\cdot M$$

where $\pi=3.141\ldots$

In the known agitator ball mills, even when n is constant, the agitating capacity undergoes changes because of the changes in M, and therefore the results of the dispersing or comminuting process are not uniform.

SUMMARY OF THE INVENTION

The object on which the invention is based is to provide a method for regulating the rotational speed of agitator ball mills, which guarantees a better process control.

The object is achieved, according to the invention, in that, in a method of the type mentioned in the introduction, the torque M of the agitator body is measured and the rotational speed n is so regulated that the rotational speed n, the torque M or the mechanical agitating capacity P satisfy desired values predetermined according to the relation $$P=2\pi\cdot n\cdot M(\pi=3.141\ldots).$$

As a result of the method according to the invention, by regulating the rotational speed n either the latter, the torque M or the mechanical agitating capacity P can be kept constant. This permits a process control which is decisively improved in relation to conventional agitator ball mills.

The invention can be used for vertically or horizontally operable agitator ball mills with a continuous or intermittent operating mode. It is advantageous in agitator ball mills both for use in the laboratory and for production.

The rotational speed n can be measured either by known mechanical or inductive methods.

As is likewise known, the torque M can be determined, for example, by strain gages, by the utilization of helical measuring shafts, by eddy-current methods, by determining a reaction torque or else by measuring the current consumption of an electric motor, taking into account the engine characteristic. The last-mentioned method is advantageous especially when a disk-rotor motor is used as a drive for the agitator body.

Although it is already known to record and indicate the current consumption of the drive motor in agitator ball mills, this is nevertheless intended to detect at an early stage an overload of the motor caused by too high a torque on the agitator shaft.

To determine the mechanical agitating capacity from the measured values for the rotational speed n and the torque M, the measurement data n and M are preferably entered in a computing unit. This calculates the value for the mechanical agitating capacity P on the basis of the abovementioned equation. The measured values n, M and P are compared with the predetermined desired value n', M' or P' respectively. The rotational speed of a shaft is then regulated via a regulator unit by means of a control pulse n'' dependent on the comparison result.

The measured or calculated values for one or more of the quantities n, M and P and, if appropriate, the predetermined desired value can be stored for documentation and/or further processing. They can be made available as analog signals or in digitized form by an external computer or an x/t-recorder. The computer can also perform process-control functions as a control device in conjunction with a corresponding peripheral.

The values are appropriately indicated in order to allow a check of the measured or calculated quantities n, M and P and of the regulating operation.

A device for carrying out the method according to the invention has measuring devices for measuring the rotational speed n and the torque M of the agitator body of the agitator ball mill and a control device, by means of which the rotational speed n can be so regulated that the rotational speed n, the torque M or the mechanical agitating capacity P satisfy desired values predetermined according to the abovementioned equation.

In a preferred version of such a device, the desired values, n', M' and P' for the quantities n, M and P can be entered in the control device. The control device is connected to the measuring devices for transmitting the measurement data and to the drive of the agitator body for regulating the rotational speed n.

The control device can have electronic modules for determining the mechanical agitating capacity P in dependence on the measurement values for the quantities n and M and an electronic regulating unit for regulating the rotational speed n.

On the other hand, the control device can comprise an external computer for determining the mechanical agitating capacity P in dependence on the measurement values for the quantities n and M and a speed transmitter for regulating the rotational speed n.

Furthermore, the control device can have a memory, in which the measured or calculated values for one or more of the quantities n, M and P and/or the predetermined desired value can be stored for documentation and/or further processing.

The control device can also have an indicator device, by means of which the values mentioned can be displayed on a pointer scale or digitally.

A preferred exemplary embodiment of the invention is illustrated hereafter by means of the drawing.

BRIEF DESCRIPTION OF THE DRAWING

The drawing shows a basic diagram for regulating the rotational speed of an agitator ball mill.

DESCRIPTION OF THE PREFERRED EMBODIMENTS

As shown partially in section in the drawing, the agitator ball mill 1 consists of a grinding chamber 2 with grinding balls 3 contained therein, a rotatably mounted agitator body 4 arranged in the grinding chamber 2, and an electric motor 5 for driving the agitator body.

Located on the agitator shaft 6 of the agitator body 4 are a measuring device 7 for the rotational speed n and a measuring device 8 for the torque M. The measuring device 7 can, for example, determine the rotational speed n inductively. In the measuring device 8, the torque M can be measured, for example, by means of the current consumption of an electric motor.

As represented by arrows in the drawing, the measurement data for the quantities n and M are transmitted from the measuring devices 7 and 8 to a control device 9.

The measurement or measured values for the quantities n and M are stored in the control device 9. In a computing unit 13, of the control device 9, the value for the mechanical agitating capacity P is determined from the measurement measured values for the quantities n and M by means of the equation $$P=2\pi\cdot n\cdot M(\pi=3.141\ldots)$$

wherein

P' is power measured in netwon-meter per second (watt), $\pi$ is approximately 3.141, $2\pi$ is the rotary distance, n' is the desired rotational speed of the shaft measured in rps (resolutions per second), and M' is the desired torque of the agitator body.

As represented by arrows in the drawing, desired values n', M' and P' for the quantities n, M or P, respectively, can be entered in the control device 9. The desired values n', M' and P' relate to each other identically as set forth in the latter formula, except, of course, the latter are desired value whereas the formula is set forth in predetermined values. Both the desired and the measured values are stored in a storage unit 14 in the control device 9. The measured values n, M, P are compared with the entered desired values n', M', P', respectively, in a comparator unit 15.

By means of a control pulse n' dependent on the comparison result, the rotational speed n is regulated by a regulator unit 16 for the electric motors. The speed regulation is illustrated diagrammatically in the drawing by an arrow.

The control device 9 possesses, furthermore pointer scales 17, 18, 19 and 21, 22, 23, for indicating the values for the quantities n', M', P' and n, M and P, respectively. The pointer scales are appropriately arranged next to one another in the same way as the quantities P, n and M in the abovementioned equation.

I claim:

1. A method of controlling the operation of an agitator ball mill of the type having a grinding chamber housing grinding balls and an agitator body rotated by a shaft through a variable speed motor comprising the steps of:

(a) establishing a desired mechanical agitating value (P') in accordance with the formula $$P'=2\pi\cdot n'\cdot M'$$

wherein

P' is power measured in newton-meter per second (watt), $\pi$ is approximately 3.141, $2\pi n'$ is the desired rotational speed of the shaft measured in rps (revolutions per second), and M' is the desired torque of the agitator body measured in the newton-meter;

(b) measuring the actual rotational speed ($2\pi n$) of the shaft and the actual torque (M) of the agitator body;

(c) calculating the actual mechanical agitating value (P) from the actual rotational speed ($2\pi n$) and the actual torque (M) in accordance with the formula $$P=2\pi\cdot n\cdot M$$

(d) comparing the desired mechanical agitating value (P') and the actual mechanical agitating value (P); and (e) based upon the result of the comparison of step (d) selectively varying the speed of the variable speed motor to substantially maintain the actual mechanical agitating value (P) commensurate to the desired mechanical agitating value (P').

2. Apparatus for controlling the operation of an agitator ball mill comprising an agitator ball mill of the type having a grinding chamber housing grinding balls and an agitator body located in said grinding chamber, a shaft for rotating said agitator body through a variable speed motor, (a) means for establishing a desired mechanical agitating value (P') in accordance with the formula $$P'=2\pi\cdot n'\cdot M'$$

wherein

P' is power measured in newton-meter per second (watt), $\pi$ is approximately 3.141, $2\pi n'$ is the desired rotational speed of the shaft measured in rps (revolutions per second), and M' is the desired torque of the agitator body measured in the newton-meter;

(b) means for measuring the actual rotational speed ($2\pi n$) of the shaft and the actual torque (M) of the agitator body;

(c) means for calculating the actual mechanical agitating value (P) from the actual rotational speed ($2\pi n$) and the actual torque (M) in accordance with the formula $$P=2\pi\cdot n\cdot M$$

(d) means for comparing the desired mechanical agitating value (P') and the actual mechanical agitating value (P); and (e) means for selectively varying the speed of the variable speed motor based upon the result of said comparing means to substantially maintain the actual mechanical agitating value (P) commensurate to the desired mechanical agitating value (P').

3. The apparatus as defined in claim 2 including means for storing the measured actual rotational speed ($2\pi n$) of said shaft and the actual torque (M) of said agitator body.

4. The apparatus as defined in claim 2 including means for storing the desired rotational speed ($2\pi n'$) of said shaft and the desired torque (M') of said agitator body.

5. The apparatus as defined in claim 2 including means for storing the measured actual rotational speed ($2\pi n$) of said shaft and the actual torque (M) of said agitator body, and means for storing the desired rotational speed ($2\pi n'$) of said shaft and the desired torque (M') of said agitator body.

6. The apparatus as defined in claim 2 including means for indicating at least one of said desired rotational speed ($2\pi n'$), torque (M') and power (P').

7. The apparatus as defined in claim 2 including means for indicating at least one of said measured rotational speed ($2\pi n'$), torque (M) and power (P).

8. The apparatus as defined in claim 2 including means for indicating at least one of said desired and measured rotational speeds ($2\pi n'$, $2\pi n$), torques (M', M) and power (P', P).

* * * * *